US012799636B2

(12) United States Patent
Kobashi et al.

(10) Patent No.: US 12,799,636 B2
(45) Date of Patent: Nov. 17, 2026

(54) ANTIBACTERIAL ACRYLIC ARTIFICIAL HAIR FIBERS, HAIR ORNAMENT PRODUCT INCLUDING SAME, AND METHOD FOR PRODUCING SAME

(71) Applicant: KANEKA CORPORATION, Osaka (JP)

(72) Inventors: Takaaki Kobashi, Hyogo (JP); Akihiro Okamoto, Hyogo (JP); Takeshi Tanaka, Hyogo (JP)

(73) Assignee: KANEKA CORPORATION, Osaka (JP)

( * ) Notice: Subject to any disclaimer, the term of this patent is extended or adjusted under 35 U.S.C. 154(b) by 287 days.

(21) Appl. No.: 18/621,470

(22) Filed: Mar. 29, 2024

(65) Prior Publication Data

US 2024/0240363 A1 Jul. 18, 2024

Related U.S. Application Data

(63) Continuation of application No. PCT/JP2022/034092, filed on Sep. 12, 2022.

(30) Foreign Application Priority Data

Sep. 30, 2021 (JP) ..... 2021-161706
Mar. 30, 2022 (JP) ..... 2022-056902

(51) Int. Cl.

| | |
|---|---|
| ***D01F 6/40*** | (2006.01) |
| ***A41G 3/00*** | (2006.01) |
| ***A41G 5/00*** | (2006.01) |
| ***D01D 5/06*** | (2006.01) |
| ***D01F 6/32*** | (2006.01) |
| ***D01F 11/06*** | (2006.01) |
| ***D06M 13/224*** | (2006.01) |
| ***D06M 15/03*** | (2006.01) |
| ***D06M 16/00*** | (2006.01) |
| ***D06M 101/28*** | (2006.01) |

(52) U.S. Cl.

CPC ..... *D01F 6/40* (2013.01); *A41G 3/0083* (2013.01); *A41G 5/004* (2013.01); *D01D 5/06* (2013.01); *D01F 6/32* (2013.01); *D01F 11/06* (2013.01); *D06M 13/2243* (2013.01); *D06M 15/03* (2013.01); *D06M 16/00* (2013.01); *D06M 2101/28* (2013.01); *D10B 2321/08* (2013.01); *D10B 2401/13* (2013.01); *D10B 2503/08* (2013.01)

(58) Field of Classification Search

None

See application file for complete search history.

(56) References Cited

U.S. PATENT DOCUMENTS

| | | | | |
|---|---|---|---|---|
| 4,536,324 | A * | 8/1985 | Fujiwara | A61K 8/14 264/4.1 |
| 6,524,508 | B1 | 2/2003 | Ohnishi et al. | |
| 6,551,705 | B1 * | 4/2003 | Ohnishi | D01F 6/18 428/364 |
| 2008/0003434 | A1 * | 1/2008 | Kuroda | D06M 16/00 428/378 |
| 2021/0164130 | A1 | 6/2021 | Yoshikawa et al. | |

FOREIGN PATENT DOCUMENTS

| | | | |
|---|---|---|---|
| JP | H10-158978 | A | 6/1998 |
| JP | 2002-227028 | A | 8/2002 |
| JP | 4191930 | * | 10/2002 |
| JP | 2006-149510 | A | 6/2006 |
| JP | 2006149510 | * | 6/2006 |
| WO | 98/12369 | A1 | 3/1998 |
| WO | 2007/094176 | A1 | 8/2007 |
| WO | 2020/039704 | A1 | 2/2020 |

OTHER PUBLICATIONS

Machine Translation of JP2006149510 (Year: 2006).*
Machine Translation of JP4191930 (Year: 2002).*
International Search Report issued in corresponding International Application No. PCT/JP2022/034092 mailed Nov. 1, 2022 (2 pages).

* cited by examiner

*Primary Examiner* — Shawn Mckinnon

(74) *Attorney, Agent, or Firm* — Osha Bergman Watanabe & Burton LLP

(57) ABSTRACT

Described are antibacterial acrylic artificial hair fibers containing chitosan and a nonionic surfactant. The amount of chitosan extracted with diluted acetic acid is 0.005% by weight to 0.4% by weight. The amount of chitosan extracted with concentrated hydrochloric acid is 0.013% by weight to 1.3% by weight. The nonionic surfactant contains a sorbitan fatty acid ester and a polyoxyethylene triglyceride. The amount of the nonionic surfactant is 0.1% by weight to 0.9% by weight, and the percentage of the sorbitan fatty acid ester in the nonionic surfactant is 20% by weight to 90% by weight.

18 Claims, No Drawings

ANTIBACTERIAL ACRYLIC ARTIFICIAL HAIR FIBERS, HAIR ORNAMENT PRODUCT INCLUDING SAME, AND METHOD FOR PRODUCING SAME

TECHNICAL FIELD

One or more embodiments of the present invention relate to antibacterial acrylic artificial hair fibers used in hair ornament products such as hairpieces, hair ornament products including the same, and a method for producing the same.

BACKGROUND

Human hair or artificial hair have conventionally been used for hair ornament products such as hairpieces. However, in recent years, it has become difficult to obtain human hair. For this reason, there is a growing demand for artificial hair. Acrylic fibers, which have similar touch, gloss, and voluminousness to human hair, have been favorably used as artificial hair. For example, Patent Document 1 proposes artificial hair in which fibers, which are formed using an acrylic polymer containing acrylonitrile, a halogen-containing vinyl-based monomer such as vinyl chloride, and a vinyl-based monomer that is copolymerizable with them, are used.

However, conventional acrylic artificial hair described in Patent Document 1 has poor antibacterial properties, and has a problem of generation or proliferation of bacteria when artificial hair is worn for a long period of time or when artificial hair is stored after it is worn, for example.

Patent Document 2 proposes antibacterial acrylic fibers containing chitosan and a quaternary ammonium salt, as acrylic fibers used in clothing.

PRIOR ART DOCUMENTS

Patent Document

[Patent Document 1] JP 2002-227028A

[Patent Document 2] JP H10-158978A

Oils are applied to synthetic fibers in order to suppress static electricity or the like. However, when an oil is applied to acrylic fibers containing chitosan, the touch deteriorates, making it difficult to use the acrylic fibers as artificial hair.

SUMMARY

In one or more embodiments of the present invention provide antibacterial acrylic artificial hair fibers having favorable antibacterial properties and smooth touch, hair ornament products including the same, and a method for producing the same.

One or more embodiments of the present invention relate to an antibacterial acrylic artificial hair fiber containing chitosan and a nonionic surfactant, in which a content of the chitosan extracted with diluted acetic acid in the antibacterial acrylic artificial hair fiber is 0.005% by weight to 0.4% by weight, the nonionic surfactant contains a sorbitan fatty acid ester and a polyoxyethylene triglyceride, a content of the nonionic surfactant in the antibacterial acrylic artificial hair fiber is 0.10% by weight to 0.90% by weight, and a percentage of the sorbitan fatty acid ester in the nonionic surfactant is 20% by weight to 90% by weight.

One or more embodiments of the present invention relate to an antibacterial acrylic artificial hair fiber containing chitosan and a nonionic surfactant, in which a content of the chitosan extracted with concentrated hydrochloric acid in the antibacterial acrylic artificial hair fiber is 0.013% by weight to 1.3% by weight, the nonionic surfactant contains a sorbitan fatty acid ester and a polyoxyethylene glyceride, a content of the nonionic surfactant in the antibacterial acrylic artificial hair fiber is 0.10% by weight to 0.90% by weight, and a percentage of the sorbitan fatty acid ester in the nonionic surfactant is 20% by weight to 90% by weight.

One or more embodiments of the present invention relate to a hair ornament product containing the antibacterial acrylic artificial hair fibers.

One or more embodiments of the present invention relate to a method for producing the antibacterial acrylic artificial hair fibers, the method including wet-spinning a spinning solution containing an acrylic copolymer, in which chitosan and a nonionic surfactant are applied to the resulting filament before the filament is dried, and the nonionic surfactant contains a sorbitan fatty acid ester and a polyoxyethylene triglyceride.

According to one or more embodiments of the present invention, it is possible to provide antibacterial acrylic artificial hair fibers having favorable antibacterial properties and smooth touch, and hair ornament products including the same.

Also, using the production method according to one or more embodiments of the present invention, antibacterial acrylic artificial hair fibers having favorable antibacterial properties and smooth touch may be obtained through wet-spinning.

DETAILED DESCRIPTION

The inventors of the present invention repeatedly conducted studies regarding how to impart antibacterial properties to acrylic artificial hair fibers and improve touch of artificial hair. As a result, the inventors of the present invention found that antibacterial acrylic artificial hair fibers having favorable antibacterial properties and smooth touch can be obtained by using a nonionic surfactant serving as an oil, that is, a mixture of a sorbitan fatty acid ester and a polyoxyethylene triglyceride at a specific ratio, and setting the contents of chitosan and the nonionic surfactant to a predetermined range. Additionally, the antibacterial acrylic artificial hair fibers according to one or more embodiments of the present invention have deodorization properties, using chitosan in combination with the sorbitan fatty acid ester and the polyoxyethylene triglyceride at a specific ratio. Further, the antibacterial acrylic artificial hair fibers according to one or more embodiments of the present invention have antiviral properties, by using chitosan in combination with the sorbitan fatty acid ester and the polyoxyethylene triglyceride at a specific ratio. In addition, the antibacterial acrylic artificial hair fibers according to one or more embodiments of the present invention have odor resistance, by using chitosan in combination with the sorbitan fatty acid ester and the polyoxyethylene triglyceride at a specific ratio.

In one or more embodiments of the present invention, a numerical range indicated by " . . . to . . . " includes two end values. For example, a numerical range indicated by "X to Y" includes two end values of X and Y. According to this disclosure, when a plurality of numerical ranges are mentioned, the numerical ranges include appropriate combinations of upper and lower limits of different numerical ranges.

Antibacterial Acrylic Artificial Hair Fibers

Antibacterial acrylic artificial hair fibers contain chitosan and nonionic surfactants (sorbitan fatty acid ester and polyoxyethylene triglyceride).

Chitosan is a product obtained by deacetylating chitin, which is a natural polymer. For example, chitosan can be obtained by deacetylating chitin, which is obtained from the exoskeleton of crustaceans, such as crabs and prawns, through boiling in a concentrated alkali or the like. There is no particular limitation on the degree of deacetylation of chitosan. In one or more embodiments, the degree of deacetylation of chitosan is approximately 60% to approximately 99%. For example, from the viewpoint of deodorization properties of the antibacterial acrylic artificial hair fibers, the degree of deacetylation of chitosan may be 70% to 99%, such as 80% to 99%. The degree of deacetylation of chitosan may be measured, for example, through NMR spectroscopy, infrared absorption spectroscopy (IR), colloid titration, and the like. There is no particular limitation on the weight average molecular weight of chitosan. The weight average molecular weight of chitosan may be approximately 10,000 to approximately 1,000,000. From the viewpoint of handleability of an aqueous solution, the weight average molecular weight of chitosan may be 10,000 to 500,000, such as 10,000 to 300,000. In one or more embodiments specification, the weight average molecular weight of a compound may be measured through gel permeation chromatography (GPC), and the weight average molecular weight may be determined in terms of polystyrene by performing GPC measurement using chloroform as a mobile phase and a polystyrene gel column.

Because antibacterial acrylic artificial hair fibers are likely to come into contact with skin and mouth during use, from the viewpoint of safety, chitosan contains only a small amount of allergens. Chitosan is often purified from raw materials derived from crustaceans, and thus may contain crustacean protein, which is one type of allergen. The content of crustacean protein in chitosan is, for example, 9.9 μg or less, such as 5.0 μg or less, such as 1.0 μg or less per gram of chitosan. For example, it may be determined that a sample containing 10 μg or more of protein derived from a specific raw material and the like per gram of sample food weight contains more than a trace amount of the specific raw material. The content of proteins in chitosan can be measured using, for example, ELISA. Specifically, the content of crustacean protein in chitosan can be measured through ELISA using Crustacean Kit II "Maruha Nichiro" manufactured by Maruha Nichiro Corporation or FA test EIA-Crutacean II "Nissui" manufactured by Nissui Pharmaceutical Co., Ltd.

In one or more embodiments, having content of chitosan extracted with diluted acetic acid in the antibacterial acrylic artificial hair fibers may be 0.005% by weight to 0.4% by weight. If the chitosan content is excessively low, the antibacterial properties may be poor. On the other hand, if the chitosan content is excessively high, it may be difficult to draw the antibacterial acrylic artificial hair fibers, resulting in poor process stability. From the viewpoint of antibacterial properties, the content of chitosan extracted with diluted acetic acid may be 0.01% by weight or more. From the viewpoint of favorable antibacterial properties and high deodorizing performance, the content of chitosan extracted with diluted acetic acid may be 0.02% by weight or more, such as 0.03% by weight or more, such as 0.05% by weight or more, such as 0.06% by weight or more. From the viewpoint of improving drawing properties and gloss, the content of chitosan extracted with diluted acetic acid may be 0.35% by weight or less, such as 0.3% by weight or less, such as 0.25% by weight or less, such as 0.2% by weight or less. In this specification, the content of chitosan extracted with diluted acetic acid may be measured and calculated as follows.

Exemplary Content of Chitosan Extracted with Diluted Acetic Acid 1) 1.87 g of glycine and 1.46 g of sodium chloride are dissolved in pure water to prepare a 250-g solution, and then 0.1 M hydrochloric acid is added until the pH reaches 3.2 to produce a buffer solution.
2) 150 mg of Reactive Red 4 is dissolved in pure water to prepare a 100-g solution, and 5 g of the solution is diluted into 50 times the solution, with the buffer solution produced in 1), to produce a dye solution.
3) 3.0 g of fibers and 20 g of a 0.1% by weight acetic acid aqueous solution are introduced into a glass bottle and heated at 90 °C for 1 hour to produce an extraction liquid.
4) The extraction liquid is allowed to cool, and then 5 mL of the dye solution and 0.5 mL of the extraction liquid are mixed immediately, and the absorbance at 578 nm is measured using a UV visible spectrophotometer. At this time, a mixture of 0.5 mL of the buffer solution and 5 mL of the dye solution is used as a reference.
5) A calibration curve is created using the absorbance at 578 nm using a mixture of 5 mL of the dye solution and 0.5 mL of a chitosan aqueous solution prepared at 0.0025% by weight to 0.025% by weight using the mixture of the 0.5 mL of the buffer solution and 5 mL of the dye solution as the reference. The chitosan concentration in the extraction liquid is calculated based on the calibration curve and the absorbance value determined in 4), and the content of chitosan extracted with the diluted acetic acid is determined.

The content of chitosan in the antibacterial acrylic artificial hair fibers may be represented as the content of chitosan extracted with diluted acetic acid by extracting chitosan using diluted acetic acid as described above, or may be represented as the content of chitosan extracted with concentrated hydrochloric acid by extracting chitosan using concentrated hydrochloric acid as described above. Note that when chitosan is extracted with concentrated hydrochloric acid, most of the chitosan may be extracted from the fibers.

In one or more embodiments having the content of chitosan extracted with concentrated hydrochloric acid in the antibacterial acrylic artificial hair fibers may be 0.013% by weight to 1.3% by weight. If the chitosan content is excessively low, the antibacterial properties may be poor. On the other hand, if the chitosan content is excessively high, it may be difficult to draw the antibacterial acrylic artificial hair fibers, resulting in poor process stability. From the viewpoint of antibacterial properties, the content of chitosan extracted with concentrated hydrochloric acid may be 0.015% by weight or more, such as 0.02% by weight or more. From the viewpoint of favorable antibacterial properties and high deodorizing performance, the content of chitosan extracted with concentrated hydrochloric acid may be 0.04% by weight or more, such as 0.06% by weight or more, such as 0.08% by weight or more, such as 0.09% by weight or more. From the viewpoint of improving drawing properties and gloss, the content of chitosan extracted with concentrated hydrochloric acid may be 1.0% by weight or less, such as 0.8% by weight or less, such as 0.7% by weight or less, such as 0.6% by weight or less, such as 0.5% by weight or less, such as 0.4% by weight or less. In this specification, the content of chitosan extracted with concentrated hydrochloric acid may be measured and calculated as follows.

Exemplary Content of Chitosan Extracted with Concentrated Hydrochloric Acid

1) Chitosan is decomposed by heating 0.2 g of a pulverized fiber sample under reflux using 10 mL of 12N hydrochloric acid, the volume is adjusted with water to 20 mL, and thus a chitosan decomposition solution is obtained.
2) To 30 mL of water, 2 mL of the chitosan decomposition solution and 3.8 g of sodium borate are added, the resulting mixture is neutralized with 12N hydrochloric acid to have a pH of 7, and the volume is adjusted to 50 mL.
3) A HPLC test solution is prepared by mixing 1 mL of the solution obtained in 2) with the derivatization reagent 9-fluorenylmethyl chloroformate (20 mg/20 mL acetonitrile solution), leaving the mixture for 24 hours, and adding 3 mL of a mixed solvent of acetonitrile: water=1:1 (containing 0.25% formic acid).
4) The content of chitosan extracted with concentrated hydrochloric acid is determined using the peak area obtained through HPLC analysis and the calibration curve created using glucosamine hydrochloride.

There is no particular limitation on the sorbitan fatty acid ester, and for example, it is possible to use an ester of sorbitan and a fatty acid as appropriate. In one or more embodiments, the fatty acid may have, for example, 4 to 30 carbon atoms. From the viewpoint of touch, the fatty acid may have 6 to 28 carbon atoms, such as 8 to 26 carbon atoms, such as 10 to 24 carbon atoms, such as 12 to 20 carbon atoms. A carbon chain of the fatty acid may be linear or branched. The fatty acid may be a saturated fatty acid or an unsaturated fatty acid. The ester may be any one of monoesters, diesters, triesters, and tetraesters.

Examples of the saturated fatty acid include lauric acid, palmitic acid, heptadecanoic acid, stearic acid, arachidic acid, behenic acid, tetracosanoic acid, hexacosanoic acid, and octacosanoic acid.

Examples of the unsaturated fatty acid include palmitoleic acid, oleic acid, vaccenic acid, nervonic acid, linoleic acid, eicosadienoic acid, linolenic acid, mead acid, and arachidonic acid.

From the viewpoint of touch, sorbitan fatty acid esters of saturated fatty acids may be the sorbitan fatty acid ester. In one or more embodiments, the sorbitan fatty acid esters of a saturated fatty acid have 10 to 24 carbon atoms, such as 12 to 22 carbon atoms. In one or more embodiments, the sorbitan fatty acid ester may be one or more selected from the group consisting of sorbitan monostearate, sorbitan monolaurate, sorbitan monopalmitate, sorbitan distearate, sorbitan dilaurate, sorbitan dipalmitate, sorbitan tristearate, sorbitan trilaurate, and sorbitan tripalmitate. The sorbitan fatty acid esters may be used alone or in combination of two or more.

There is no particular limitation on polyoxyethylene triglyceride, and examples thereof include 2-ethylcaproic acid polyoxyethylene triglyceride, lauric acid polyoxyethylene triglyceride, myristic acid polyoxyethylene triglyceride, palmitic acid polyoxyethylene triglyceride, stearic acid polyoxyethylene triglyceride, crotonic acid polyoxyethylene triglyceride, palmitoleic acid polyoxyethylene triglyceride, linoleic acid polyoxyethylene triglyceride, linolenic acid polyoxyethylene triglyceride, oleic acid polyoxyethylene triglyceride, polyoxyethylene coconut oil, polyoxyethylene castor oil, and polyoxyethylene hydrogenated castor oil. The polyoxyethylene triglycerides may be used alone or in combination of two or more.

The average number of moles of oxyethylene groups added in polyoxyethylene triglyceride may be, for example, although not particularly limited, 10 to 200 moles, such as 25 to 200 moles, such as 50 to 200 moles, such as 50 to 150 moles.

From the viewpoint of easily dispersing the sorbitan fatty acid ester uniformly, the polyoxyethylene triglyceride may be one or more selected from the group consisting of polyoxyethylene coconut oil, polyoxyethylene castor oil, polyoxyethylene hydrogenated castor oil, and the like. In one or more embodiments, the average number of moles of ethyleneoxy groups added in polyoxyethylene castor oil and/or polyoxyethylene hydrogenated castor oil may be 50 to 200 moles, such as 100 to 150 moles.

In one or more embodiments, the content of the nonionic surfactant (the total content of sorbitan fatty acid ester and polyoxyethylene triglyceride) in the antibacterial acrylic artificial hair fibers may be 0.10% by weight to 0.90% by weight. When the content of the nonionic surfactant is less than 0.10% by weight, process stability and processability may decrease due to static electricity generation. When the content of the nonionic surfactant exceeds 0.90% by weight, touch may deteriorate. The content of the nonionic surfactant may be 0.80% by weight or less, such as 0.70% by weight or less, such as 0.60% by weight or less, such as 0.50% by weight or less. In this specification, the content of nonionic surfactant (also referred to as the "oil adhesion amount" hereinafter) may be measured as follows.

Oil Adhesion Amount

A sample (fibers) having a weight of about 2 g (sample weight W0) is cut to 12 to 15 cm and is filled into a stainless steel tube (an oil extraction tube) with a lower end having a hole with a size of about 1 mm. Then, 35 mL of a mixture of ethanol and cyclohexane at a ratio of ethanol:cyclohexane=1:1 (weight ratio) is prepared as liquid for extracting an oil, and about 20 mL of the extraction liquid is introduced into the oil extraction tube. A lid of the oil extraction tube is adjusted such that the dropping rate of the extraction liquid is about 1 drop/1 to 1.5 seconds, and extraction of the oil is started. At this time, a tray (empty tray weight W1) heated to 120 °C using a heater is used as a tray for a dropping solution and set such that the dropping solution will be dropped onto the tray. When dropping of the solution is completed, the lid is temporarily removed, and the fibers present in the oil extraction tube are pressed using a stainless steel rod to squeeze out the extraction liquid. This operation is performed again using the remaining extraction liquid (about 15 mL). After the extraction is completed, the tray is placed in an oven at 90 °C, taken out in 5 minutes. The total tray weight (W2) of the tray where the extraction liquid has dried and evaporated and only the oil remains is measured, and the oil adhesion amount (% by weight) is calculated using Formula 1 below.

$$\text{Oil adhesion amount (\% by weight)} = (W2 - W1)/W0 \times 100 \quad \text{[Formula 1]}$$

In one or more embodiments, the percentage of sorbitan fatty acid ester in the nonionic surfactant (oil) (i.e., to the total weight of sorbitan fatty acid ester and polyoxyethylene triglyceride) may be 20% by weight to 90% by weight, and the percentage of polyoxyethylene triglyceride therein may be 10% by weight to 80% by weight. If the percentage of sorbitan fatty acid ester is less than 20% by weight or the percentage of polyoxyethylene triglyceride exceeds 80% by weight, touch may deteriorate. If the percentage of sorbitan fatty acid ester exceeds 90% by weight or the percentage of polyoxyethylene triglyceride is less than 10% by weight, the sorbitan fatty acid ester may not be uniformly dispersed. From the viewpoint of touch, the percentage of sorbitan fatty acid ester may be 25% by weight or more, such as 30% by weight or more, such as 35% by weight or more, such as 40% by weight or more. In this specification, the percentage of sorbitan fatty acid ester may be measured as follows.

Percentage of Sorbitan Fatty Acid Ester

In the antibacterial acrylic artificial hair fibers, the percentage of sorbitan fatty acid ester in the nonionic surfactant (oil) may be calculated by dissolving and dispersing the antibacterial acrylic artificial hair fibers in acetone, precipitating a resin component constituting the fibers using chloroform, concentrating the soluble content, adding deuterated chloroform to the resulting soluble concentrate to remove the insoluble content, and analyzing the soluble content through 1H NMR.

In the antibacterial acrylic artificial hair fibers, there is no particular limitation on the HLB of the nonionic surfactant, specifically, the sorbitan fatty acid ester or polyoxyethylene triglyceride. From the viewpoint of gloss, the HLB thereof may be, for example, 13.0 or more, 13.5 or more, 14.0 or more, 14.5 or more, or 15.0 or more. Also, from the viewpoint of emulsifying properties, the HLB of sorbitan fatty acid ester or polyoxyethylene triglyceride may be 19 or less. In this specification, the HLB (hydrophilic-lipophilic balance) of the nonionic surfactant may be determined using Griffin's method.

In the antibacterial acrylic artificial hair fibers, there is no particular limitation on the melting point of the nonionic surfactant, specifically, the sorbitan fatty acid ester or polyoxyethylene triglyceride. From the viewpoint of gloss, the melting point thereof may be, for example, 25 °C or less, 22°C or less, or 20 °C or less. In this specification, the melting point of the nonionic surfactant may be determined using a visual observation method or the like.

There is no particular limitation on the acrylic copolymer that constitutes the antibacterial acrylic artificial hair fibers, and it is possible to use, for example, an acrylic copolymer containing acrylonitrile in an amount of less than 95% by weight and other monomers in an amount of more than 5% by weight. In one or more embodiments, an acrylic copolymer containing acrylonitrile in an amount of less than 80% by weight and other monomers in an amount of more than 20% by weight may be used. Specifically, the acrylic copolymer may contain acrylonitrile in an amount of 29.5% by weight to 79.5% by weight, one or more chlorine containing monomers selected from the group consisting of vinyl chloride and vinylidene chloride in an amount of 20% by weight to 70% by weight, and a sulfonic acid group-containing vinyl monomer in an amount of 0.5% by weight to 5% by weight. When the content of acrylonitrile in the acrylic copolymer is 29.5% by weight to 79.5% by weight, the antibacterial acrylic artificial hair fibers may have favorable heat resistance. When the acrylic copolymer contains one or more chlorine-containing monomers selected from the group consisting of vinyl chloride and vinylidene chloride in an amount of 20% by weight to 70% by weight, the antibacterial acrylic artificial hair fibers may have favorable flame retardance. When the acrylic copolymer contains a sulfonic acid group-containing vinyl monomer in an amount of 0.5% by weight to 5% by weight, hydrophilicity may increase. In one or more embodiments, the acrylic copolymer may contain acrylonitrile in an amount of 34.5% by weight to 74.5% by weight, one or more chlorine-containing monomers selected from the group consisting of vinyl chloride and vinylidene chloride in an amount of 25% by weight to 65% by weight, and a sulfonic acid group-containing vinyl monomer in an amount of 0.5% by weight to 5% by weight. In one or more embodiments, the acrylic copolymer may contain acrylonitrile in an amount of 39.5% by weight to 74.5% by weight, vinyl chloride in an amount of 25% by weight to 60% by weight, and a sulfonic acid group-containing vinyl monomer in an amount of 0.5% by weight to 5% by weight. In one or more embodiments, the acrylic copolymer may contain acrylonitrile in an amount of 39.5% by weight to 69.5% by weight, vinyl chloride in an amount of 30% by weight to 60% by weight, and a sulfonic acid group-containing vinyl monomer in an amount of 0.5% by weight to 5% by weight. In one or more embodiments the acrylic copolymer may contain acrylonitrile in an amount of 39.5% by weight to 59.5% by weight, vinyl chloride in an amount of 40% by weight to 60% by weight, and a sulfonic acid group-containing vinyl monomer in an amount of 0.5% by weight to 5% by weight. In one or more embodiments, the acrylic copolymer may contain acrylonitrile in an amount of 39.5% by weight to 49.5% by weight, vinyl chloride in an amount of 50% by weight to 60% by weight, and a sulfonic acid group-containing vinyl monomer in an amount of 0.5% by weight to 5% by weight. From the viewpoint of a good touch, the acrylic copolymer may contain vinyl chloride.

There is no particular limitation on the sulfonic acid group-containing vinyl monomer, and it is possible to use, as a sulfonic acid group-containing vinyl monomer, for example, allyl sulfonic acid, methallyl sulfonic acid, styrenesulfonic acid, isoprene sulfonic acid, 2-acrylamido-2-methylpropanesulfonic acid, and metal salts such as sodium salts thereof, and amine salts thereof, and the like. The sulfonic acid group-containing vinyl monomers may be used alone or in combination of two or more.

In one or more embodiments of the present invention, antibacterial acrylic artificial hair fibers may contain another additive agent for improving fiber properties as needed as long as it does not impede effects of the present invention. Examples of the additive agent include gloss modifiers, coloring agents such as organic pigments, inorganic pigments, and dyes, light stabilizers, heat stabilizers, fiber sizing agents, deodorants, and fragrances. From the viewpoint of touch and the stability of the chitosan-containing oil, the antibacterial acrylic artificial hair fibers may contain only a sorbitan fatty acid ester and polyoxyethylene triglyceride, which are nonionic surfactants, as an oil. Note that when the antibacterial acrylic artificial hair fibers contain another oil, from the viewpoint of touch, the total content of other oils, the sorbitan fatty acid ester, and polyoxyethylene triglyceride may be 0.90% by weight or less.

From the viewpoint of suitably using antibacterial acrylic artificial hair fibers as artificial hair, the antibacterial acrylic artificial hair fibers may have a single fiber fineness of 10 to 100 dtex, such as 20 to 95 dtex, such as 25 to 85 dtex, such as 30 to 75 dtex, such as 35 to 65 dtex.

From the viewpoint of favorable antibacterial properties, the antibacterial acrylic artificial hair fibers may have an antibacterial activity value of 2.2 or more, 3.0 or more, or 4.0 or more, the antibacterial activity value being measured in accordance with JIS L 1902: 2015. From the viewpoint of favorable antibacterial properties even after washing, the antibacterial acrylic artificial hair fibers may have an antibacterial activity value of 4.0 or more, such as 4.5 or more, the antibacterial activity value being measured after washing in accordance with JIS L 1902: 2015. The antibacterial acrylic artificial hair fibers have powerful antibacterial properties against bacteria such as *Staphylococcus aureus*, for example.

From the viewpoint of high odor resistance, as for the antibacterial acrylic artificial hair fibers, the volatilization amount of isovaleric acid generated through the growth of bacteria such as *Staphylococcus aureus* may be 150 μg or less, 100 μg or less, or 70 μg or less, per kilogram of the antibacterial acrylic artificial hair fibers. Isovaleric acid is known as an odor component generated from the scalp. In this disclosure, the volatilization amount of isovaleric acid generated through the growth of bacteria may be specifically measured as described in Examples.

From the viewpoint of providing a smoother touch, the antibacterial acrylic artificial hair fibers may have a mean coefficient of friction (MIU) of 0.00365 or less, 0.00350 or less, or 0.00320 or less. In this specification, the mean coefficient of friction may be measured using a friction tester (KES-SE-STP manufactured by Kato Tech Co., Ltd.) as described in Examples.

From the viewpoint of favorable antiviral properties, the antibacterial acrylic artificial hair fibers may have an antiviral activity value of 3.0 or more, 3.5 or more, or 4.0 or more, the antiviral activity value being measured in accordance with JIS L 1922: 2016. From the viewpoint of favorable antiviral properties even after washing, the antibacterial acrylic artificial hair fibers may have an antiviral activity value of 2.0 or more, such as 3.0 or more, the antiviral activity value being measured in accordance with JIS L 1922: 2016 after washing is performed ten times. The antibacterial acrylic artificial hair fibers have powerful antiviral properties against influenza A virus, for example.

The antibacterial acrylic artificial hair fibers have powerful deodorization properties, and for example, the percentage for deodorizing isovaleric acid may be 60% or more, 70% or more, 80% or more, or 90% or more. In this specification, the deodorization properties may be specifically measured as described in Examples.

Production Method

Antibacterial acrylic artificial hair fibers may be produced by, for example, wet-spinning a spinning solution containing an acrylic copolymer and applying chitosan and nonionic surfactants (sorbitan fatty acid ester and polyoxyethylene triglyceride) to filaments before the filaments are dried.

The spinning solution may be obtained by, for example, dissolving an acrylic copolymer in an organic solvent. There is no particular limitation on the organic solvent, and it is possible to use a good solvent for an acrylic copolymer as appropriate. Examples of the good solvent include dimethyl sulfoxide (DMSO), dimethylacetamide (DMAc), N,N-dimethylformamide (DMF), and acetone. From the viewpoint of versatility, acetone may be used. From the viewpoint of high safety, dimethyl sulfoxide may be used. The spinning solution may contain a small amount of water, for example, may contain water in an amount of 1.5% by weight to 4.8% by weight. Accordingly, it is possible to suppress formation of voids.

In one or more embodiments, the spinning solution may contain an epoxy group-containing compound in an amount of 0.1 parts by weight or more, 0.2 parts by weight or more, and even more preferably 0.3 parts by weight or more, with respect to 100 parts by weight of the acrylic copolymer. An epoxy group-containing compound may be added to the spinning solution because the epoxy group-containing compound may suppress odor, coloring of the fibers due to heat, devitrification of the fibers due to hot water, and the like. In particular, when dimethyl sulfoxide is used as an organic solvent, it may be possible to effectively suppress the generation of malodorous components formed through decomposition of dimethyl sulfoxide when acrylic artificial hair fibers are heated. Also, from the viewpoint of spinnability, fiber quality, and cost, the spinning solution may contain an epoxy group-containing compound in an amount of 5 parts by weight or less, 3 parts by weight or less, or 1 part by weight or less, with respect to 100 parts by weight of the acrylic copolymer.

It is possible to use, as the epoxy group-containing compound, for example, glycidyl methacrylate-containing polymers, glycidyl acrylate-containing polymers, epoxidized vegetable oils, glycidyl ether type epoxy resins, glycidyl amine type epoxy resins, glycidyl ester type epoxy resins, and cycloaliphatic epoxy resins. The epoxy group-containing compounds may be used alone or in combination of two or more.

From the viewpoint of epoxy equivalent (the weight of resin containing 1 equivalent of epoxy groups), inhibition of fiber coloration, solubility of the epoxy group-containing compound in dimethyl sulfoxide, and reduction in elution thereof into a spinning bath, the epoxy group-containing compound is preferably a glycidyl methacrylate-containing polymer and/or a glycidyl acrylate-containing polymer, and more preferably polyglycidyl methacrylate.

There is no particular limitation on the weight average molecular weight of the epoxy group-containing compound, and for example, the weight average molecular weight of the epoxy group-containing compound may be determined as appropriate, in consideration of solubility in dimethyl sulfoxide and elution into the spinning bath. When the epoxy group-containing compound is a glycidyl methacrylate-containing polymer and/or a glycidyl acrylate containing polymer, the weight average molecular weight may be 3,000 or more, for example, from the viewpoint of reducing elution into the spinning bath, and the weight average molecular weight may be 100,000 or less from the viewpoint of solubility of the epoxy group-containing compound into an organic solvent such as dimethyl sulfoxide.

The spinning solution may contain another additive agent for improving fiber properties as needed as long as it does not impede effects of the present invention. Examples of the additive agent include gloss modifiers, coloring agents such as organic pigments, inorganic pigments, and dyes, and stabilizers for improving light resistance and heat resistance.

The wet-spinning may include at least a coagulation process, a water washing process, and a drying process. The wet-spinning preferably includes a wet-drawing process performed before the water washing process or after the water washing process and before the drying process. From the viewpoint of the durability of chitosan, chitosan, sorbitan fatty acid ester, and polyoxyethylene triglyceride may need to be applied (hereinafter, also referred to as an "oil application process") before the drying process. In one or more embodiments, the amount of chitosan applied may be about 3 times the desired amount of chitosan extracted with acetic acid in the obtained acrylic fibers, or about 1.5 times the desired amount of chitosan extracted with concentrated hydrochloric acid in the obtained acrylic fibers. The oil application process may be performed after the wet-drawing process. Also, from the viewpoint of fiber strength, the production method may include a dry-drawing process, which may be performed after the drying process. Further, if necessary, the production method may include a thermal relaxation treatment, which may be performed after the dry-drawing process.

First, in the coagulation process, filaments (also referred to as coagulated filaments) may be formed by discharging the spinning solution into the coagulation bath through a spinning nozzle and coagulating the spinning solution. The spinning nozzle may be used as appropriate depending on a desired fiber cross section. There is no particular limitation on the fiber cross section, and the fiber cross section may be any cross section, such as a circular, elliptical, or irregular shaped cross section.

There is no particular limitation on the spinning speed, and, for example, from the viewpoint of industrial productivity, the spinning speed is preferably 2 to 17 m/min. There is no particular limitation on the nozzle draft, and, for example, from the viewpoint of production process stability, the nozzle draft is preferably 0.8 to 2.0.

It is possible to use, for example, an aqueous solution in which a good solvent such as dimethyl sulfoxide has a concentration of 20% by weight to 70% by weight, as the coagulation bath. The temperature of the coagulation bath may be set to 5 °C to 40 °C. If the concentration of the organic solvent in the coagulation bath is excessively low, it is possible that coagulation will progress quickly, the coagulation structure will become coarse, and voids will form inside the fibers.

Then, in the wet-drawing process, the acrylic fibers (coagulated filaments) may be wet-drawn (also referred to as primary drawing) in a drawing bath. It is possible to use, as the drawing bath, an aqueous solution in which a good solvent, such as dimethyl sulfoxide, has a lower concentration than that in the coagulation bath. In one or more embodiments, the temperature of the drawing bath may be 30 °C or more, 40 °C or more, or 50 °C or more. There is no particular limitation on a draw ratio, and the draw ratio may be 2 to 8 times, from the viewpoint of increasing the strength and productivity of fibers. Note that when primary drawing is performed using a water bath, a wet-drawing process may be performed after a water washing process, which will be described later, or primary drawing and water washing may be performed simultaneously.

Then, in the water washing process, a good solvent, such as dimethyl sulfoxide, may be removed from the acrylic fibers by washing the acrylic fibers with warm water at 30 °C or more. Alternatively, the coagulated filaments may be introduced into warm water at 30 °C or more, and primary drawing and water washing may be performed simultaneously. Alternatively, primary drawing may be performed after the water washing process is performed. A good solvent, such as dimethyl sulfoxide, may be easily removed from the acrylic fibers by, for example, using warm water at 70 °C or more in the water washing process.

Then, in the oil application process, chitosan, sorbitan fatty acid ester, and polyoxyethylene triglyceride (nonionic surfactant) are applied to filaments using a chitosan-containing oil composition in which chitosan, sorbitan fatty acid ester, and polyoxyethylene triglyceride are dissolved in water or dispersed therein. In the oil application process, in order to improve a curl setting property using hot water, one or more organic solvents selected from the group consisting of dimethyl sulfone, ε-caprolactam, ethylene carbonate, sulfolane, and the like may be applied to the filaments.

The chitosan-containing oil composition may contain, for example, chitosan in an amount of 0.05% by weight to 5% by weight, and a nonionic surfactant in an amount of 0.5% by weight to 10% by weight. In one or more embodiments, the chitosan-containing oil composition contains acetic acid, hydrochloric acid, or the like in order to dissolve chitosan. The weight ratio between sorbitan fatty acid ester and polyoxyethylene triglyceride in the chitosan-containing oil composition may be sorbitan fatty acid ester:polyoxyethylene triglyceride=20 to 90:10 to 80. The ratio of sorbitan fatty acid ester to polyoxyethylene triglyceride in the fibers may be approximately the same as the ratio of sorbitan fatty acid ester to polyoxyethylene triglyceride in the chitosan-containing oil composition.

There is no particular limitation on the chitosan-containing oil composition, and the chitosan-containing oil composition may contain, for example, chitosan in an amount of 0.05% by weight to 5% by weight, acetic acid in an amount of 0.025% by weight to 10% by weight, sorbitan fatty acid ester in an amount of 0.5% by weight to 10% by weight, and polyoxyethylene triglyceride in an amount of 0.5% by weight to 10% by weight (note that the total amount of sorbitan fatty acid ester and polyoxyethylene triglyceride is 0.5% by weight to 10% by weight), and the remainder may be water. Alternatively, the chitosan-containing oil composition may contain, for example, chitosan in an amount of 0.05% by weight to 5% by weight, acetic acid in an amount of 0.025% by weight to 10% by weight, sorbitan fatty acid ester in an amount of 0.5% by weight to 10% by weight, polyoxyethylene triglyceride in an amount of 0.5% by weight to 10% by weight (note that the total amount of sorbitan fatty acid ester and polyoxyethylene triglyceride is 0.5% by weight to 10% by weight), and dimethyl sulfone in an amount of 0.1% by weight to 5% by weight, and the remainder may be water.

The chitosan-containing oil composition may contain another additive agent for improving fiber properties as needed as long as it does not impede effects of the present invention. Examples of the additive agent may include fiber sizing agents, such as urethane-based polymers and cationic ester polymers.

Then, the acrylic fibers may be dried in the drying process. There is no particular limitation on the drying temperature, and the drying temperature may be, for example, 110 °C to 190 °C. In one or more embodiments, the dried fibers may be further subjected to dry-drawing (also referred to as secondary drawing). There is no particular limitation on the drawing temperature for secondary drawing, and the drawing temperature may be, for example, 110 °C to 190 °C. There is no particular limitation on the draw ratio, and for example, the draw ratio may be 1 to 4 times, 1 to 3 times, or 1 or 2 times. The total draw ratio including wet-drawing before drying may be performed 2 to 10 times, 2 to 8 times, 2 to 6 times, or 2 to 4 times.

After dry-drawing is performed, the fibers may be relaxed in a thermal relaxation treatment process. There is no particular limitation on a relaxation percentage, and, for example, the relaxation percentage may be 5% or more, or 10% to 30%. The thermal relaxation treatment may be performed at a high temperature, for example, in a dry heat atmosphere at 140 °C to 200° ° C. or in a superheated steam atmosphere.

Hair Ornament Products

There is no particular limitation on hair ornament products, and examples thereof may include hair wigs, hairpieces, weaving hair, hair extensions, braided hair, hair accessories, and doll hair. The antibacterial acrylic artificial hair fibers may be used alone as artificial hair to form a hair ornament product. Alternatively, in addition to the antibacterial acrylic artificial hair fibers, other artificial hair fibers and natural fibers, such as human hair and animal hair, may be used in combination to form a hair ornament product. There is no particular limitation on the other artificial hair fibers, and examples thereof may include polyvinyl chloride-based fibers, nylon fibers, polyester fibers, and regenerated collagen fibers.

EXAMPLES

Hereinafter, one or more embodiments of the present invention will be described by way of examples, but the present invention is not limited to examples below.

A measurement method and an evaluation method used in examples and comparative examples are as follows.

Single Fiber Fineness

Using an auto-vibronic fineness measuring device "DENIER COMPUTER Type DC-11" (manufactured by Search Co., Ltd.), the fineness of 30 samples was measured to determine their respective single fiber fineness, and the average of the measured values of the samples was calculated and taken as the single fiber fineness of the fibers.

Content of Chitosan Extracted with Diluted Acetic Acid

Using the following procedure, chitosan was extracted from the fibers using diluted acetic acid, and the content of chitosan extracted with diluted acetic acid was determined.

1) 1.87 g of glycine (Fujifilm Wako Pure Chemical Corporation) and 1.46 g of sodium chloride (Fujifilm Wako Pure Chemical Corporation) were dissolved in pure water to prepare a 250-g solution, and then 0.1 M hydrochloric acid (Fujifilm Wako Pure Chemical Corporation) was added until the pH reached 3.2 to produce a buffer solution.
2) 150 mg of Reactive Red 4 (MP Biomedicals, LLC) was dissolved in pure water to prepare a 100-g solution, and 5 g of the solution was diluted into 50 times the solution with the buffer solution produced in 1), to produce a dye solution.
3) 3.0 g of the fibers and 20 g of a 0.1% by weight acetic acid aqueous solution were introduced into a glass bottle, and heated at 90 °C for 1 hour to produce an extraction liquid.
4) The extraction liquid was allowed to cool, 5 mL of the dye solution and 0.5 mL of the extraction liquid were mixed immediately, and the absorbance at 578 nm was measured using a UV visible spectrophotometer (UV-1800, Shimadzu Corporation). At this time, a mixture of 0.5 mL of the buffer solution and 5 mL of the dye solution was used as a reference.
5) A calibration curve was created using the absorbance at 578 nm using a mixture of 5 mL of the dye solution and 0.5 mL of a chitosan aqueous solution prepared at 0.0025% by weight to 0.025% by weight using the mixture of 0.5 mL of the buffer solution and 5 mL of the dye solution as the reference. The chitosan concentration in the extraction liquid was calculated based on the calibration curve and the absorbance value determined in 4), and the content of chitosan extracted with the diluted acetic acid was determined.

Content of Chitosan Extracted with Concentrated Hydrochloric Acid

Using the following procedure, chitosan was extracted from the fibers using concentrated hydrochloric acid, and the content of chitosan extracted with concentrated hydrochloric acid was determined.

1) Chitosan was decomposed by heating 0.2 g of a pulverized fiber sample under reflux using 10 mL of 12N hydrochloric acid, the volume was adjusted with water to 20 mL, and thus a chitosan decomposition solution was obtained.
2) To 30 mL of water, 2 mL of the chitosan decomposition solution and 3.8 g of sodium borate were added, the resulting mixture was neutralized with 12N hydrochloric acid to have a pH of 7, and the volume was adjusted to 50 mL.
3) An HPLC test solution was prepared by mixing 1 mL of the solution obtained in 2) with the derivatization reagent 9-fluorenylmethyl chloroformate (20 mg/20 mL acetonitrile solution), leaving the mixture for 24 hours, and adding 3 mL of a mixed solvent of acetonitrile:water=1:1 (containing 0.25% formic acid).
4) The content of chitosan extracted with concentrated hydrochloric acid was determined using the peak area obtained through HPLC analysis, and the calibration curve created using glucosamine hydrochloride.

Oil Adhesion Amount

A sample (fibers) having a weight of about 2 g (sample weight W0) was cut to 12 to 15 cm, and was filled into a stainless steel tube (an oil extraction tube) having a lower end with a hole having a size of about 1 mm. Then, 35 mL of a mixture of ethanol and cyclohexane at a ratio of ethanol:cyclohexane=1:1 (weight ratio) was prepared as a liquid for extracting an oil, and about 20 mL of the extraction liquid was introduced into the oil extraction tube. A lid of the oil extraction tube was adjusted such that the dropping rate of the extraction liquid was about 1 drop/1 to 1.5 seconds, and extraction of the oil was started. At this time, a tray (empty tray weight W1) heated to 120 °C using a heater was used as a tray for a dropping solution and set such that the dropping solution would be dropped onto the tray. When dropping of the solution was completed, the lid was temporarily removed, and the fibers present in the oil extraction tube were pressed using a stainless steel rod to squeeze out the extraction liquid. This operation was performed again using the remaining extraction liquid (about 15 mL). After the extraction was completed, the tray was placed in an oven at 90 °C, taken out in 5 minutes, the total tray weight (W2) of the tray where the extraction liquid had dried and evaporated and only the oil remained was measured, and the oil adhesion amount (% by weight) was calculated using Formula 1 below.

$$\text{Oil adhesion amount (\% by weight)} = (W2 - W1)/W0 \times 100 \quad \text{[Formula 1]}$$

Percentage of Sorbitan Fatty Acid Ester in Fibers

The percentage of sorbitan fatty acid ester to the total amount of sorbitan fatty acid ester and polyoxyethylene triglyceride in the chitosan-containing oil composition was determined and used as the percentage of sorbitan fatty acid ester in the fibers. Note that if the blend ratio between sorbitan fatty acid ester and polyoxyethylene triglyceride in the chitosan-containing oil composition is not known, the percentage of sorbitan fatty acid ester in a mixture of sorbitan fatty acid ester and polyoxyethylene triglyceride in the fibers may be calculated by dissolving and dispersing the fibers in acetone, precipitating a resin component constituting the fiber using chloroform, concentrating the soluble content, adding deuterated chloroform to the resulting concentrate to remove the insoluble content, and analyzing the soluble content through 1H NMR.

Antibacterial Properties

The antibacterial activity value was measured by JIS L 1902: 2015 Textiles—Determination of antibacterial activity and efficacy of textile products (Absorption method). *Staphylococcus aureus* was used in testing. In order to prevent the shape of a sample from deteriorating, testing was conducted without performing high-pressure steam sterilization on the sample. According to the "Certification Standard of SEK Mark Textile Products", when a sample has an antibacterial activity value of 2.2 or more, the sample has antibacterial and odor resistance effects.

Odor Resistance

The volatilization amount of isovaleric acid generated through the growth of bacteria was measured using the following procedure.

1) A test bacterial solution was prepared by mixing 10 mL of 2×YT medium, 5.0 mL of 2% L-leucine, 4.8 mL of sterile water, and 0.2 mL of a microorganism suspension (*Staphylococcus aureus*, turbidity OD600=1.0).
2) A fiber sample was cut to a length of about 3 cm, 0.4 g of the sample was introduced into a 50-mL vial, 100 μL of the test bacterial solution was added, and the sample was left at 37 °C for 72 hours, to culture the microorganisms.
3) The entire amount of each sample was taken out from the vial containing the sample cultured for 72 hours, the samples are collectively placed in a 5-L sampling bag, and the cut portion was closed. The inside of the bag was degassed using a vacuum pump, 2 L of high-purity nitrogen gas was injected, and the bag was sealed.
4) The bag was left at room temperature for 2 hours, a volatile organic compound contained in 1 L of nitrogen gas in the bag was collected using a cartridge containing 2,6-diphenyl-p-phenylene oxide, and analysis was conducted using a gas chromatograph mass spectrometer. The area of the peak corresponding to isovaleric acid in a total ion chromatogram was determined using attached analysis software, and the volatilization amount was determined using a calibration curve created in advance.
5) When the operation 4 was completed, the sample was taken out from the bag and dried at 120 °C, and the dry mass of the sample was obtained.
6) The volatilization amount of isovaleric acid per kilogram of the dry mass of the fibers was calculated using the volatilization amount of isovaleric acid obtained in the operation 4 and the dry mass of the sample obtained in the operation 5. The lower limit of quantitative measurement was 42 μg/kg.

Antiviral Properties

The antiviral activity value was measured by JIS L 1922: 2016 Textiles—Determination of antiviral activity of textile products. Influenza A virus (H3N3) was used in the test. The sample was washed in accordance with the "Washing methods for SEK Mark Textile Products, Standard Washing Method" defined by Japan Textile Evaluation Technology Council. When a sample has an antiviral activity value of 2 or more, the sample has antiviral properties.

Deodorization Properties

The deodorization properties of isovaleric acid were evaluated using the following method.

1) An aqueous solution containing 0.03% isovaleric acid was prepared.
2) To the surface of 1 g of the sample, 0.2 mL of the isovaleric acid aqueous solution was applied, the sample was placed in the 1-L sampling bag, and a cut portion was closed.
3) The inside of the bag was degassed using a vacuum pump, 0.5 L of high-purity nitrogen gas was injected through an integrating flowmeter, and the bag was sealed.
4) The bag was left at room temperature (20±5 °C) for 2 hours, a volatile organic compound contained in 0.1 L of nitrogen gas in the bag was collected using a cartridge containing 2,6-diphenyl-p-phenylene oxide, and analysis was conducted using a gas chromatograph mass spectrometer. The area of the peak corresponding to isovaleric acid in a total ion chromatogram was determined using analysis software, and the gas concentration was determined using a calibration curve created in advance.
5) The gas concentration was determined in the same manner using a control instead of the sample. AFRELLE (modacrylic fibers, manufactured by Kaneka Corporation, hereinafter, also simply referred to as "AFRELLE"), which is a hair ornament product, was used as the control.
6) The deodorization percentage was determined based on the measured gas concentration using Formula 3 below.

[Formula 3]

$$\text{Deodorization percentage [\%]} = \{1 - (\text{sample gas concentration } [ppm])/(\text{control gas concentration } [ppm])\} \times 100$$

Touch

Evaluation 1

Sensory evaluation was performed by three persons who had been engaged in the beauty evaluation of hairpieces for three years or more using a fiber bundle sample with a total fineness of 1.2 million to 1.3 million dtex, and the touch was evaluated in the following three stages.

A (very good): sample was evaluated to have better touch than AFRELLE

B (good): sample was evaluated to have touch equivalent to that of AFRELLE

C (poor): sample was evaluated to have worse touch than AFRELLE

Evaluation 2

The mean coefficient of friction MIU between fibers was measured using a friction tester (KES-SE-STP manufactured by Kato Tech Co., Ltd.) using the following procedure, and touch was evaluated based on MIU in the following three stages.

Mean Coefficient of Friction MIU

1) A fiber bundle with a length of 30 cm and a weight of 4.0 g was fixed to a sample table such that its width was 3 cm.
2) A fiber bundle with a length of 12 cm and a weight of 0.8 g was fixed to a lower portion of the arm.
3) A 25-g weight was placed on the arm, and placed on the fiber bundle on the sample table.
4) The mean coefficient of friction MIU was calculated by sliding the arm with settings of SENS: H and SPEED: 0.5 mm/sec and measuring a frictional force.

Evaluation

A (very good): MIU is 0.00320 or less

B (quite good): MIU is more than 0.00320 and 0.00350 or less

C (good): MIU is more than 0.00350 and 0.00365 or less

D (poor): MIU is more than 0.00365

Example 1

An acrylic polymer containing acrylonitrile in an amount of 46% by weight, vinyl chloride in an amount of 52% by weight, and sodium styrene sulfonate in an amount of 2% by weight was dissolved in dimethyl sulfoxide (DMSO) to produce an acrylic copolymer solution having an acrylic copolymer concentration of 26.0% by weight and a water concentration of 2.7% by weight. Then, carbon black, red dye (C.I Basic Red 46), and blue dye (C.I Basic Blue 41) were added as colorants to the acrylic copolymer solution, such that the amount of carbon black was 2.1 parts by weight, the amount of red dye was 0.04 parts by weight, and the amount of blue dye was 0.07 parts by weight with respect to 100 parts by weight of the acrylic copolymer. Furthermore, polyglycidyl methacrylate (weight average molecular weight was 12,000) was added to this solution in an amount of 0.8 parts by weight with respect to 100 parts by weight of the acrylic copolymer to produce a spinning solution. The obtained spinning solution was subjected to wet-spinning by extruding the spinning solution at a spinning speed of 2 m/min in a coagulation bath including an aqueous solution of DMSO having a temperature of 25 °C and a concentration of 47% by weight, using a spinning nozzle (having a hole size of 0.3 mm and a hole count of 100), and then drawn to 2.1 times their original length in a drawing bath including an aqueous solution of DMSO having a temperature of 90 °C and a concentration of 50% by weight. Then, water washing was performed using warm water having a temperature of 90 °C. Subsequently, the primary drawn filaments, which had been washed with water, were impregnated with a chitosan-containing oil composition (containing chitosan in an amount of 0.05% by weight, acetic acid in an amount of 0.025% by weight, sorbitan monostearate in an amount of 1.6% by weight, polyoxyethylene (the average number of moles added was about 170) hydrogenated castor oil in an amount of 2.4% by weight, dimethyl sulfone in an amount of 2.0% by weight, and distilled water in an amount of 93.9% by weight) by immersing the filaments in an oil bath (60 °C) containing the chitosan-containing oil composition for 1 to 3 seconds, and then the filaments were dried at 140° ° C., drawn to 3 times their original length, and subjected to 27% relaxation treatment at 155 °C to obtain acrylic fibers having a single fiber fineness of about 46 dtex. Chitosan had a degree of deacetylation of 71%. The content of crustacean protein in chitosan was measured using Crustacean Kit II "Maruha Nichiro" manufactured by Maruha Nichiro Corporation and FA test EIA-Crutacean II "Nissui" manufactured by Nissui Pharmaceutical Co., Ltd., revealing that the content of crustacean protein in chitosan was 0.1 μg or less per gram of chitosan (the lower limit of quantitative measurement or less).

Example 2

Acrylic fibers having a single fiber fineness of about 46 dtex were obtained in the same manner as in Example 1, except that a composition, which contained chitosan in an amount of 0.5% by weight, acetic acid in an amount of 0.25% by weight, sorbitan monostearate in an amount of 1.6% by weight, polyoxyethylene (the average number of moles added was about 170) hydrogenated castor oil in an amount of 2.4% by weight, dimethyl sulfone in an amount of 2.0% by weight, and distilled water in an amount of 93.3% by weight, was used as a chitosan-containing oil composition.

Example 3

Acrylic fibers having a single fiber fineness of about 46 dtex were obtained in the same manner as in Example 1, except that a composition, which contained chitosan in an amount of 3.0% by weight, acetic acid in an amount of 1.5% by weight, sorbitan monostearate in an amount of 1.6% by weight, polyoxyethylene (the average number of moles added was about 170) hydrogenated castor oil in an amount of 2.4% by weight, dimethyl sulfone in an amount of 2.0% by weight, and distilled water in an amount of 89.5% by weight, was used as a chitosan-containing oil composition.

Example 4

Acrylic fibers having a single fiber fineness of about 46 dtex were obtained in the same manner as in Example 1, except that a composition, which contained chitosan in an amount of 0.5% by weight, acetic acid in an amount of 0.25% by weight, sorbitan monostearate in an amount of 0.6% by weight, polyoxyethylene (the average number of moles added was about 170) hydrogenated castor oil in an amount of 0.9% by weight, dimethyl sulfone in an amount of 2.0% by weight, and distilled water in an amount of 95.8% by weight, was used as a chitosan-containing oil composition.

Example 5

Acrylic fibers having a single fiber fineness of about 46 dtex were obtained in the same manner as in Example 1, except that a composition, which contained chitosan in an amount of 0.5% by weight, acetic acid in an amount of 0.25% by weight, sorbitan monostearate in an amount of 2.4% by weight, polyoxyethylene (the average number of moles added was about 170) hydrogenated castor oil in an amount of 3.6% by weight, dimethyl sulfone in an amount of 2.0% by weight, and distilled water in an amount of 91.3% by weight, was used as a chitosan-containing oil composition.

Example 6

Acrylic fibers having a single fiber fineness of about 46 dtex were obtained in the same manner as in Example 1, except that a composition, which contained chitosan in an amount of 0.5% by weight, acetic acid in an amount of 0.25% by weight, sorbitan monostearate in an amount of 1.2% by weight, polyoxyethylene (the average number of moles added was about 170) hydrogenated castor oil in an amount of 4.8% by weight, dimethyl sulfone in an amount of 2.0% by weight, and distilled water in an amount of 91.3% by weight, was used as a chitosan-containing oil composition.

Example 7

Acrylic fibers having a single fiber fineness of about 46 dtex were obtained in the same manner as in Example 1, except that a composition, which contained chitosan in an amount of 0.5% by weight, acetic acid in an amount of 0.25% by weight, sorbitan monostearate in an amount of 2.8% by weight, polyoxyethylene (the average number of moles added was about 170) hydrogenated castor oil in an amount of 1.2% by weight, dimethyl sulfone in an amount of 2.0% by weight, and distilled water in an amount of 93.3% by weight, was used as a chitosan-containing oil composition.

Example 8

Acrylic fibers having a single fiber fineness of about 46 dtex were obtained in the same manner as in Example 1, except that a composition, which contained chitosan in an amount of 0.5% by weight, acetic acid in an amount of 0.25% by weight, sorbitan monostearate in an amount of 3.6% by weight, polyoxyethylene (the average number of moles added was about 170) hydrogenated castor oil in an amount of 0.4% by weight, dimethyl sulfone in an amount of 2.0% by weight, and distilled water in an amount of 93.3% by weight, was used as a chitosan-containing oil composition.

Example 9

Acrylic fibers having a single fiber fineness of about 46 dtex were obtained in the same manner as in Example 1, except that a composition, which contained chitosan in an amount of 1.0% by weight, acetic acid in an amount of 0.5% by weight, sorbitan monostearate in an amount of 1.6% by weight, polyoxyethylene (the average number of moles added was about 170) hydrogenated castor oil in an amount of 2.4% by weight, dimethyl sulfone in an amount of 2.0% by weight, and distilled water in an amount of 92.5% by weight, was used as a chitosan-containing oil composition.

Example 10

Acrylic fibers having a single fiber fineness of about 46 dtex were obtained in the same manner as in Example 1, except that a composition, which contained chitosan in an amount of 0.5% by weight, acetic acid in an amount of 0.25% by weight, sorbitan monolaurate in an amount of 2.0% by weight, polyoxyethylene (the average number of moles added was about 170) hydrogenated castor oil in an amount of 2.0% by weight, dimethyl sulfone in an amount of 2.0% by weight, and distilled water in an amount of 93.3% by weight, was used as a chitosan-containing oil composition.

Comparative Example 1

Filaments were impregnated with a chitosan-containing oil composition in the same manner as in Example 1 and dried at 140 °C, except that a composition, which contained chitosan in an amount of 5.0% by weight, acetic acid in an amount of 2.5% by weight, sorbitan monostearate in an amount of 1.6% by weight, polyoxyethylene (the average number of moles added was about 170) hydrogenated castor oil in an amount of 2.4% by weight, dimethyl sulfone in an amount of 2.0% by weight, and distilled water in an amount of 86.5% by weight, was used as the chitosan-containing oil composition. Then, attempts were made to perform drawing, but drawing failed.

Comparative Example 2

Acrylic fibers having a single fiber fineness of about 46 dtex were produced in the same manner as in Example 1, except that a composition, which contained chitosan in an amount of 0.5% by weight, acetic acid in an amount of 0.25% by weight, sorbitan monostearate in an amount of 0.3% by weight, polyoxyethylene (the average number of moles added was about 170) hydrogenated castor oil in an amount of 0.5% by weight, dimethyl sulfone in an amount of 2.0% by weight, and distilled water in an amount of 96.5% by weight, was used as a chitosan-containing oil composition, but the acrylic fibers had strong static electricity and were hard to handle.

Comparative Example 3

Acrylic fibers having a single fiber fineness of about 46 dtex were obtained in the same manner as in Example 1, except that a composition, which contained chitosan in an amount of 0.5% by weight, acetic acid in an amount of 0.25% by weight, sorbitan monostearate in an amount of 4.0% by weight, polyoxyethylene (the average number of moles added was about 170) hydrogenated castor oil in an amount of 6.0% by weight, dimethyl sulfone in an amount of 2.0% by weight, and distilled water in an amount of 87.3% by weight, was used as a chitosan-containing oil composition.

Comparative Example 4

Acrylic fibers having a single fiber fineness of about 46 dtex were obtained in the same manner as in Example 1, except that a composition, which contained chitosan in an amount of 0.5% by weight, acetic acid in an amount of 0.25% by weight, sorbitan monostearate in an amount of 0.6% by weight, polyoxyethylene (the average number of moles added was about 170) hydrogenated castor oil in an amount of 5.4% by weight, dimethyl sulfone in an amount of 2.0% by weight, and distilled water in an amount of 91.3% by weight, was used as a chitosan-containing oil composition.

Comparative Example 5

When a composition, which contained chitosan in an amount of 0.5% by weight, acetic acid in an amount of 0.25% by weight, sorbitan monostearate in an amount of 4.0% by weight, dimethyl sulfone in an amount of 2.0% by weight, and distilled water in an amount of 93.3% by weight, was used as a chitosan-containing oil composition, the oil had poor dispersibility.

Comparative Example 6

Acrylic fibers having a single fiber fineness of about 46 dtex were obtained in the same manner as in Example 1, except that a composition, which contained chitosan in an amount of 0.5% by weight, acetic acid in an amount of 0.25% by weight, ethylene oxide propylene oxide block polyether (mole ratio of ethylene oxide/propylene oxide=20/80, weight average molecular weight was 2400) in an amount of 5.0% by weight, dimethyl sulfone in an amount of 2.0% by weight, and distilled water in an amount of 92.3% by weight, was used as a chitosan-containing oil composition.

Comparative Example 7

Acrylic fibers having a single fiber fineness of about 46 dtex were obtained in the same manner as in Example 1, except that a composition, which contained chitosan in an amount of 1.0% by weight, acetic acid in an amount of 0.5% by weight, polyethylene glycol 400 (PEG400) in an amount of 6.0% by weight, dimethyl sulfone in an amount of 2.0% by weight, and distilled water in an amount of 90.5% by weight, was used as a chitosan-containing oil composition.

The chitosan content, the oil adhesion amount, the percentage of sorbitan fatty acid ester, antibacterial properties, odor resistance, touch, and gloss of the acrylic fibers of Examples and Comparative Examples were measured and evaluated as described above, and the results are shown in Table 1 below. In Table 1 below, the percentage of sorbitan fatty acid ester in the oil bath refers to the weight percent of sorbitan fatty acid ester to the total weight of sorbitan fatty acid ester and polyoxyethylene triglyceride in the oil bath performed ten times, were respectively 4.5 and 3.0, and thus the acrylic fibers of Example 9 had favorable antiviral properties, in particular, also had favorable antiviral properties after washing was performed ten times.

On the other hand, in Comparative Example 1, in which the content of chitosan extracted with diluted acetic acid exceeded 0.4% by weight or the content of chitosan extracted with concentrated hydrochloric acid exceeded 1.3% by weight, drawing failed after chitosan was applied, and process stability was poor. In Comparative Example 2, in which the oil adhesion amount, i.e., the total content of sorbitan fatty acid ester and polyoxyethylene triglyceride was less than 0.1% by weight, static electricity was generated, and thus process stability and processability were poor.

TABLE 1

| | Percentage of sorbitan fatty acid ester in oil bath (% by weight) | Content of chitosan extracted with diluted acetic acid (% by weight) | Content of chitosan extracted with concentrated hydrochloric acid (% by weight) | Oil adhesion amount (% by weight) | Percentage of sorbitan fatty acid ester in fibers (% by weight) | Antibacterial activity value | Odor resistance Isovaleric acid volatilization amount (μg/kg) | Touch Evaluation 1 | Touch Evaluation 2 MIU ($\times 10^{-2}$) | Touch Evaluation 2 Evaluation |
|---|---|---|---|---|---|---|---|---|---|---|
| Ex. 1 | 40 | 0.005 | 0.013 | 0.4 | 40 | 3.2 | 5500 | A | 0.364 | C |
| Ex. 2 | 40 | 0.05 | 0.13 | 0.4 | 40 | 5.7 | 45 | A | 0.360 | C |
| Ex. 3 | 40 | 0.3 | 0.65 | 0.4 | 40 | 6.2 | 42 or less | A | 0.278 | A |
| Ex. 4 | 40 | 0.05 | 0.09 | 0.1 | 40 | 5.9 | 42 or less | A | 0.283 | A |
| Ex. 5 | 40 | 0.05 | 0.10 | 0.6 | 40 | 6.0 | 42 or less | B | 0.361 | C |
| Ex. 6 | 20 | 0.05 | 0.09 | 0.4 | 20 | 4.8 | Not | B | 0.349 | B |
| Ex. 7 | 70 | 0.05 | 0.09 | 0.4 | 70 | 5.6 | measured | A | 0.363 | C |
| Ex. 8 | 90 | 0.05 | 0.10 | 0.4 | 90 | 4.6 | | A | 0.227 | A |
| Ex. 9 | 40 | 0.1 | 0.23 | 0.4 | 40 | 5.9 | | A | 0.338 | B |
| Ex. 10 | 50 | 0.05 | 0.09 | 0.4 | 50 | 6.1 | | B | 0.357 | C |
| Comp. Ex. 1 | 40 | 0.5 | 1.40 | 0.4 | Drawing failed after chitosan was applied | | | | | |
| Comp. Ex. 2 | 40 | 0.05 | 0.08 | 0.05 | 40 | 5.7 | Not measured | A | 0.247 | A |
| Comp. Ex. 3 | 40 | 0.05 | 0.07 | 1 | 40 | 3.6 | | C | 0.434 | D |
| Comp. Ex. 4 | 10 | 0.05 | 0.08 | 0.4 | 10 | 4.7 | | C | 0.374 | D |
| Comp. Ex. 5 | 100 | Dispersion of oil failed | | | | | | | | |
| Comp. Ex. 6 | 0 | 0.05 | 0.07 | 0.1 | 0 | 5.9 | Not measured | C | 0.373 | D |
| Comp. Ex. 7 | 0 | 0.1 | 0.20 | 0.1 | 0 | 5.7 | | C | 0.369 | D |

As can be seen from Table 1, the acrylic fibers of the Examples had favorable antibacterial properties and a smooth touch, and thus had a favorable touch. Also, the acrylic fibers of Examples 2 to 4, in which the content of chitosan extracted with diluted acetic acid was 0.02% by weight or more or the content of chitosan extracted with concentrated hydrochloric acid was 0.04% by weight or more, had an isovaleric acid volatilization amount of 70 μg or less per kilogram of the fibers, and also had favorable odor resistance. Also, the deodorization properties of the acrylic fibers of Examples 2 and 9 were evaluated as described above, which revealed that the acrylic fibers of Example 2 had a deodorization percentage of 63% and the acrylic fibers of Example 9 had a deodorization percentage of 74%, and thus also had favorable deodorization properties. Furthermore, the antiviral properties of the acrylic fibers of Example 9 were evaluated as described above, which revealed that the antiviral activity values obtained when washing was not performed and after washing was In Comparative Example 3, in which the oil adhesion amount, i.e., the total content of sorbitan fatty acid ester and polyoxyethylene triglyceride exceeded 0.9% by weight, a touch was poor. In Comparative Example 4, in which the percentage of sorbitan fatty acid ester was less than 20% by weight, a touch was poor. In Comparative Example 5, in which only sorbitan fatty acid ester was used, the oil was not dispersed in water. In Comparative Examples 6 and 7, in which ethylene oxide/propylene oxide block polyether or PEG400 was used as a nonionic surfactant, a touch was poor.

The present invention includes one or more of the embodiments below, but is not limited thereto.

One or more embodiments of the present invention include an antibacterial acrylic artificial hair fiber containing chitosan and a nonionic surfactant, in which a content of the chitosan extracted with diluted acetic acid of the antibacterial acrylic artificial hair fiber is 0.005% by weight to 0.4% by weight, the nonionic surfactant contains a sorbitan fatty acid ester and a polyoxyethylene triglyceride, a content of the nonionic surfactant of the antibacterial acrylic artificial hair fiber is 0.10% by weight to 0.90% by weight, and a percentage of the sorbitan fatty acid ester in the nonionic surfactant is 20% by weight to 90% by weight.

One or more embodiments of the present invention include an antibacterial acrylic artificial hair fiber containing chitosan and a nonionic surfactant, in which a content of the chitosan extracted with concentrated hydrochloric acid of the antibacterial acrylic artificial hair fiber is 0.013% by weight to 1.3% by weight, the nonionic surfactant contains a sorbitan fatty acid ester and a polyoxyethylene triglyceride, a content of the nonionic surfactant of the antibacterial acrylic artificial hair fiber is 0.10% by weight to 0.90% by weight, and a percentage of the sorbitan fatty acid ester in the nonionic surfactant is 20% by weight to 90% by weight.

In another aspect, the sorbitan fatty acid ester is one or more selected from the group consisting of sorbitan monostearate, sorbitan monolaurate, sorbitan monopalmitate, sorbitan distearate, sorbitan dilaurate, sorbitan dipalmitate, sorbitan tristearate, sorbitan trilaurate, and sorbitan tripalmitate.

In another aspect, the polyoxyethylene triglyceride is one or more selected from the group consisting of polyoxyethylene castor oil and polyoxyethylene hydrogenated castor oil.

In another aspect, an acrylic copolymer that constitutes the antibacterial acrylic artificial hair fiber contains acrylonitrile in an amount of 29.5% by weight to 79.5% by weight, one or more monomers selected from the group consisting of vinyl chloride and vinylidene chloride in an amount of 20% by weight to 70% by weight, and a sulfonic acid group-containing vinyl monomer in an amount of 0.5% by weight to 5% by weight.

In another aspect, the antibacterial acrylic artificial hair fiber has a single fiber fineness of 10 to 150 dtex.

In another aspect, an antibacterial activity value of the antibacterial acrylic artificial hair fiber measured in accordance with JIS L 1902: 2015 is 2.2 or more.

In another aspect, the antibacterial acrylic artificial hair fiber has a mean coefficient of friction (MIU) of 0.00365 or less.

One or more embodiments of the present invention include a hair ornament product containing the antibacterial acrylic artificial hair fiber.

In another aspect, the hair ornament product is one selected from the group consisting of a hair wig, a hairpiece, weaving hair, a hair extension, braided hair, a hair accessory, and doll hair.

One or more embodiments of the present invention include a method for producing the antibacterial acrylic artificial hair fiber, the method including wet-spinning a spinning solution containing an acrylic copolymer, in which the chitosan and the nonionic surfactant are applied to the resulting filament before the filament is dried, and the nonionic surfactant contains a sorbitan fatty acid ester and a polyoxyethylene triglyceride.

In another aspect, the method includes applying the chitosan and the nonionic surfactant to a wet-drawn filament.

In another aspect, the method includes applying the chitosan and the nonionic surfactant to a wet-drawn filament, drying the filament, and dry-drawing the filament.

Although the disclosure has been described with respect to only a limited number of embodiments, those skilled in the art, having benefit of this disclosure, will appreciate that various other embodiments may be devised without departing from the scope of the present disclosure. Accordingly, the scope of the invention should be limited only by the attached claims.

What is claimed is:

1. An antibacterial acrylic artificial hair fiber comprising: chitosan; and a nonionic surfactant, wherein an amount of chitosan extracted with diluted acetic acid in the antibacterial acrylic artificial hair fiber is 0.005% by weight to 0.4% by weight, or an amount of chitosan extracted with concentrated hydrochloric acid in the antibacterial acrylic artificial is 0.013% by weight to 1.3% by weight, wherein the nonionic surfactant comprises a sorbitan fatty acid ester and a polyoxyethylene triglyceride, wherein an amount of the nonionic surfactant in the antibacterial acrylic artificial hair fiber is 0.10% by weight to 0.90% by weight, and wherein a percentage of the sorbitan fatty acid ester in the nonionic surfactant is 25% by weight to 90% by weight.

2. The antibacterial acrylic artificial hair fiber according to claim 1, wherein the sorbitan fatty acid ester is one or more selected from the group consisting of sorbitan monostearate, sorbitan monolaurate, sorbitan monopalmitate, sorbitan distearate, sorbitan dilaurate, sorbitan dipalmitate, sorbitan tristearate, sorbitan trilaurate, and sorbitan tripalmitate.

3. The antibacterial acrylic artificial hair fiber according to claim 1, wherein the polyoxyethylene triglyceride is one or more selected from the group consisting of polyoxyethylene castor oil and polyoxyethylene hydrogenated castor oil.

4. The antibacterial acrylic artificial hair fiber according to claim 1, wherein the antibacterial acrylic artificial hair fiber comprises an acrylic copolymer that contains acrylonitrile in an amount of 29.5% by weight to 79.5% by weight, one or more monomers selected from the group consisting of vinyl chloride and vinylidene chloride in an amount of 20% by weight to 70% by weight, and a sulfonic acid group-containing vinyl monomer in an amount of 0.5% by weight to 5% by weight.

5. The antibacterial acrylic artificial hair fiber according to claim 1, wherein the antibacterial acrylic artificial hair fiber has a single fiber fineness of 10 to 150 dtex.

6. The antibacterial acrylic artificial hair fiber according to claim 1, wherein an antibacterial activity value of the antibacterial acrylic artificial hair fiber measured in accordance with JIS L 1902:2015 is 2.2 to 6.2.

7. The antibacterial acrylic artificial hair fiber according to claim 1, wherein the antibacterial acrylic artificial hair fiber has a mean coefficient of friction (MIU) of 0.00365 or less.

8. A hair ornament product comprising the antibacterial acrylic artificial hair fiber according to claim 1.

9. The hair ornament product according to claim 8, wherein the hair ornament product is one selected from the group consisting of a hair wig, a hairpiece, weaving hair, a hair extension, braided hair, a hair accessory, and doll hair.

10. A method for producing the antibacterial acrylic artificial hair fiber according to claim 1, the method comprising wet-spinning a spinning solution containing an acrylic copolymer, wherein the chitosan and the nonionic surfactant are applied to a resulting filament before the filament is dried.

11. The method for producing the antibacterial acrylic artificial hair fiber according to claim 10, comprising applying the chitosan and the nonionic surfactant to a wet-drawn filament.

12. The method for producing the antibacterial acrylic artificial hair fiber according to claim 11, comprising applying the chitosan and the nonionic surfactant to the wet-drawn filament, drying the filament, and dry-drawing the filament.

13. The hair ornament product according to claim 8, wherein the sorbitan fatty acid ester is one or more selected from the group consisting of sorbitan monostearate, sorbitan monolaureate, sorbitan monopalmitate, sorbitan distearate, sorbitan dilaurate, sorbitan dipalmitate, sorbitan tristearate, sorbitan trilaurate, and sorbitan tripalmitate.

14. The hair ornament product according to claim 8, wherein the polyoxyethylene triglyceride is one or more selected from the group consisting of polyoxyethylene castor oil and polyoxyethylene hydrogenated castor oil.

15. The hair ornament product according to claim 8, wherein an antibacterial activity value of the antibacterial acrylic artificial hair fiber measured in accordance with JIS L 1902:2015 is 2.2 to 6.2.

16. The hair ornament product according to claim 8, wherein the antibacterial acrylic artificial hair fiber has a mean coefficient of friction (MIU) of 0.00365 or less.

17. The method for producing the antibacterial acrylic artificial hair fiber according to claim 10, wherein the sorbitan fatty acid ester is one or more selected from the group consisting of sorbitan monostearate, sorbitan monolaureate, sorbitan monopalmitate, sorbitan distearate, sorbitan dilaurate, sorbitan dipalmitate, sorbitan tristearate, sorbitan trilaurate, and sorbitan tripalmitate.

18. The method for producing the antibacterial acrylic artificial hair fiber according to claim 10, wherein the polyoxyethylene triglyceride is one or more selected from the group consisting of polyoxyethylene castor oil and polyoxyethylene hydrogenated castor oil.

* * * * *